United States Patent [19]

Hunter

[11] Patent Number: 4,501,391

[45] Date of Patent: Feb. 26, 1985

[54] HOSE END PATTERN SPRINKLER

[75] Inventor: Edwin J. Hunter, Rancho Santa Fe, Calif.

[73] Assignee: The Toro Company, Minneapolis, Minn.

[21] Appl. No.: 576,775

[22] Filed: Feb. 3, 1984

Related U.S. Application Data

[63] Continuation of Ser. No. 345,946, Feb. 4, 1982, abandoned.

[51] Int. Cl.[3] ..... B05B 1/02; B05B 3/04

[52] U.S. Cl. ..... 239/97; 239/231; 239/240; 239/394; 239/516; 239/533.1; 239/DIG. 1; 415/146

[58] Field of Search ..... 415/146, 147, 157; 137/505.18; 239/97, 206, 225, 231, 240, 390, 394, 396, 397, 516, 533.1, 570, 597, 598, 601, DIG. 1

[56] References Cited

U.S. PATENT DOCUMENTS

| | | | |
|---|---|---|---|
| 2,933,099 | 4/1960 | Lisiak | 137/505.18 X |
| 3,139,901 | 7/1964 | Camp | 137/505.18 |
| 3,358,964 | 12/1967 | Cohen et al. | 137/505.18 X |
| 3,645,451 | 2/1972 | Hauser | 239/206 |
| 4,272,024 | 6/1981 | Kah, Jr. | 239/206 |
| 4,281,793 | 8/1981 | De Witt | 239/DIG. 1 X |

FOREIGN PATENT DOCUMENTS

| | | | |
|---|---|---|---|
| 30127 | 10/1907 | Austria | 239/394 |

*Primary Examiner*—Andres Kashnikow
*Attorney, Agent, or Firm*—James W. Miller

[57] ABSTRACT

A hose end pattern sprinkler has a sprinkler housing supported on a base with a hose end coupling for connecting a garden type hose to a water inlet of the housing, a pressure regulator having an inlet pressure balanced valve member which is adjustable externally of the housing for controlling the pressure of water flowing within the housing, a variable leaf spring stator for shaping water flow from the pressure regulator into a variable width stream in response to the water pressure, a water driven turbine including an impeller wheel having turbine vanes positioned to be impinged with water flowing past the variable leaf spring, a rotatable nozzle having an outer drive gear and triangular bottom nozzle inlets having apexes converging in a center bore, and an annular pattern plate of ring configuration having an internal gear, the plate being operable externally of the housing for moving the plate beneath the associated nozzle inlets with the pattern plate having a plurality of different configured pattern orifices for controlling water flow from the associated nozzle inlets to a selectable pattern, and a stream deflector normally biased toward a maximum stream deflecting position with a water pressure responsive piston provided for moving the deflector against its bias under the force on the deflector provided by water pressure within the nozzle.

24 Claims, 16 Drawing Figures

Fig. 3.
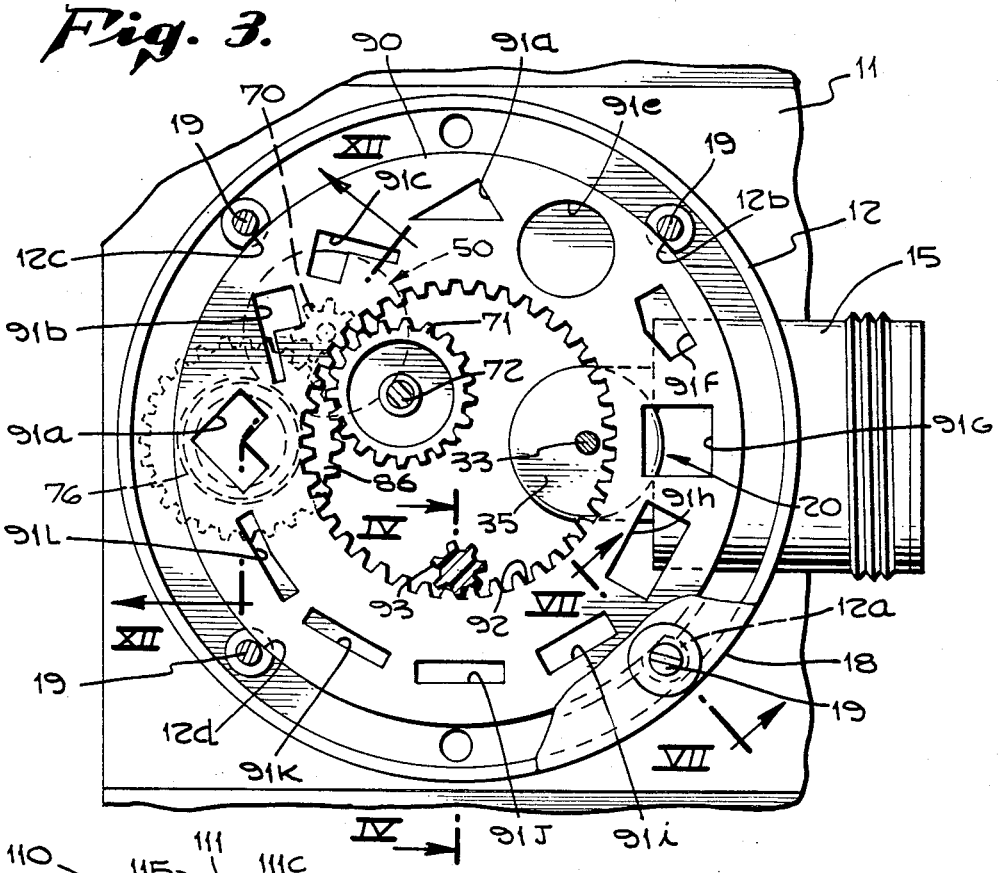
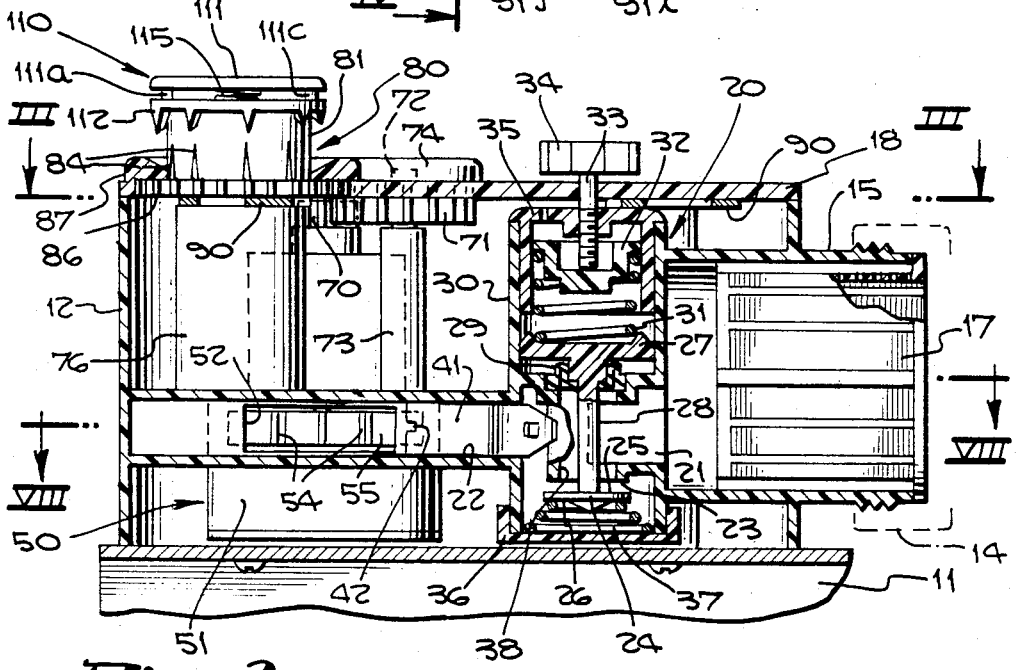
Fig. 2.

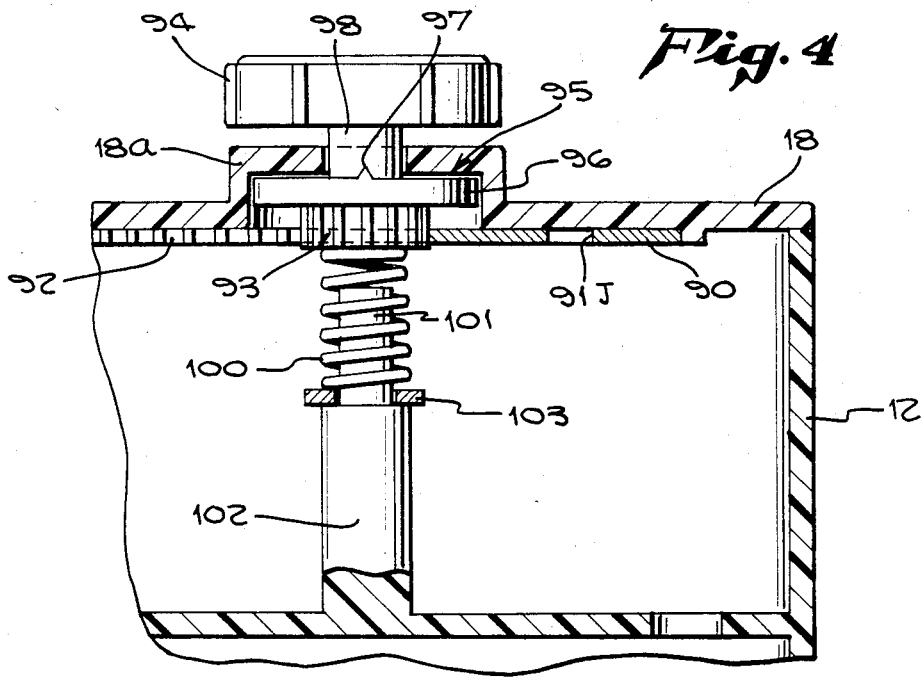
Fig. 4
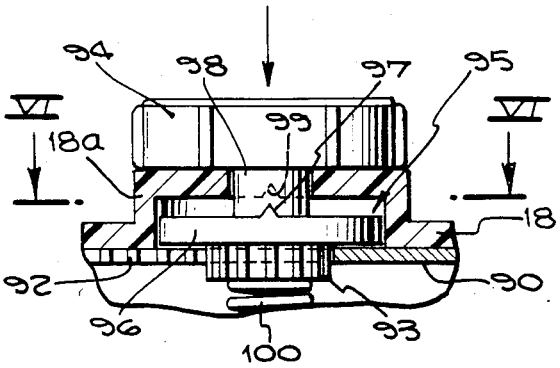
Fig. 5.
Fig. 7.
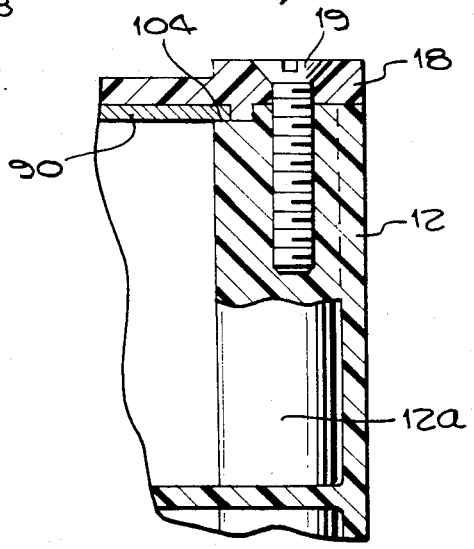
Fig. 6.
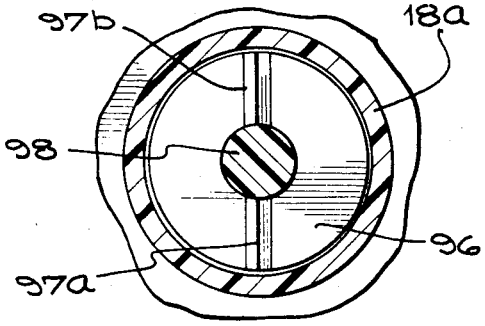

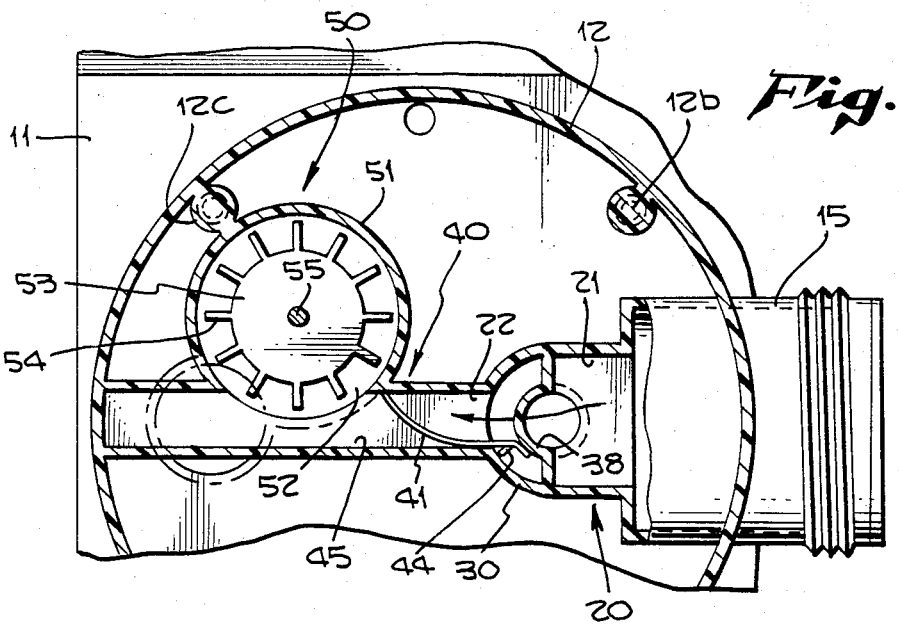
Fig. 8
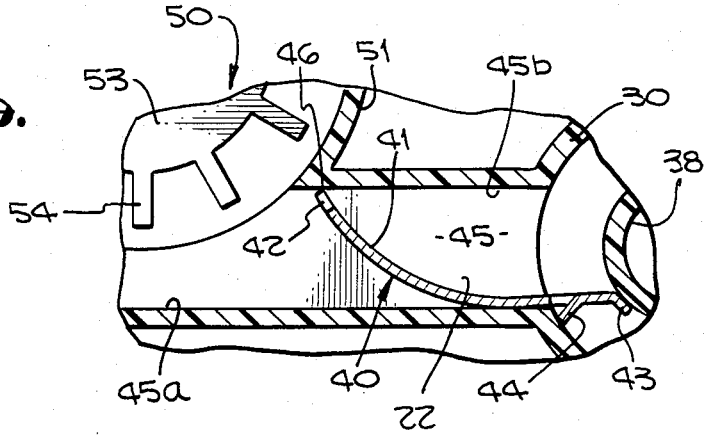
Fig. 9.
Fig. 10.
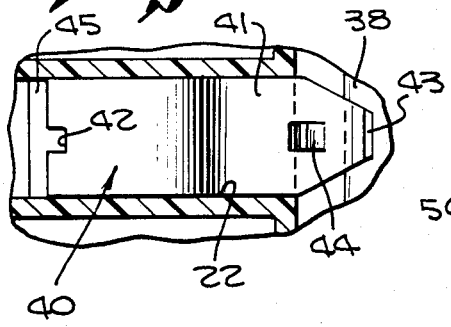
Fig. 11.
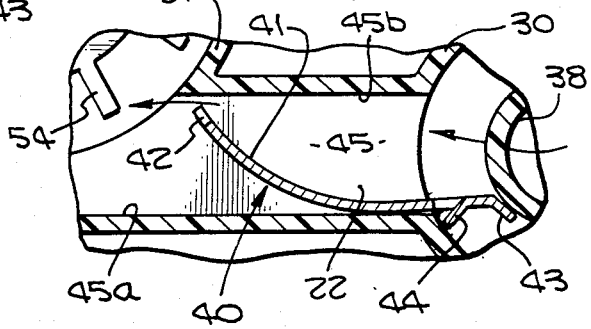

HOSE END PATTERN SPRINKLER

This application is a continuation of application Ser. No. 345,946, filed Feb. 4, 1982, now abandoned.

BACKGROUND OF THE INVENTION

The present invention relates in general to water sprinklers and means for controlling water flow emitted therefrom and more particularly to a hose end type pattern sprinkler and improvements therein.

Various types of sprinklers have been employed heretofore in commercial and residential environments which employ a pattern producing nozzle assembly. Exemplary thereof is my prior U.S. Pat. No. 3,854,664 which discloses a multiple orifice nozzle of cylindrical configuration rotated about a center shaft by water turbine means and a pattern plate positioned beneath the nozzle to control the pattern of water emitted from the nozzle. The pattern plate is fixed in the sprinkler and has its pattern producing orifice off set from a center line of the nozzle since the nozzle is driven via a center shaft arrangement. In addition to this commercial type sprinkler, there are residential use type pattern sprinklers which operate off garden hoses which have a turret which rotate over a fixed head, the head having individual stationary pattern plates selected by movement by the turrent relative thereto. Such pattern sprinklers are not adjustable to different size patterns, but are designed to give a certain shape of pattern whose size may vary to the water pressure provided by the water conduits to which they are attached.

It would therefore be desirable to provide a pattern type sprinkler wherein different patterns can be easily selected and yet the size of the pattern area sprinkled can be selectively varied and the water distribution over the pattern be maintained in a uniform manner.

SUMMARY OF THE INVENTION

It is therefore the primary object of the present invention to disclose and provide a hose end type pattern sprinkler wherein individual spray patterns for the sprinkler may be easily and quickly selected, where the pressure of water entering the sprinkler nozzle can be easily and manually adjusted, wherein water flow within the sprinkler can be effectively controlled for operating water turbine means for driving the sprinkler, wherein the sprinkler nozzle is centered over an associated pattern plate orifice and be driven off the associated water turbine means and wherein the water precipitation rate over the selected pattern is maintained in a uniform manner even though the size of the pattern is selectively changed.

Generally stated, the present invention of pattern sprinkler is of the type having a housing, a water inlet to the housing, nozzle means for spraying water from the housing and a water passage being provided within the housing communicated between the inlet and the nozzle and includes the provision of an annular pattern plate having a plurality of different configured spray orifices in a circular array with means for mounting the pattern plate in a path of water flow through the nozzle such that rotation of the pattern plate sequentially places each one of the pattern orifices successively into alignment with the nozzle.

More specifically, the nozzle is of a cylindrical body configuration having a plurality of triangularly shaped water inlets in a bottom surface thereof with the apexes of such inlets extending radially inwardly and merging at a bottom center position, vertical side outlets of upright triangular configuration with arcuate flow paths between each of the inlets and outlets whereby a plurality of nozzle outlets are provided with the inlets active area of the underside of the nozzle body extending to the center of the body to cooperate with the water flowing through a centered pattern orifice. The nozzle is driven through the provision of an external gear formed about the nozzle body and an associated water turbine means provided within the sprinkler housing.

As is particularly contemplated within the present invention, pressure means are provided in the housing between the inlet and nozzle in order to regulate the pressure of water flowing thereto. Externally adjustable manual means are provided to allow adjustment of the pressure regulator. Water flow from the pressure regulator is through a water passage in which a leaf spring stator means is provided which has a nozzle effecting notch in a free end thereof so that water flow through the passage during low water pressures through the notch, but on increased water pressures, the leaf spring body in which the notch is provided bends opening the passage to increased water flow. A water turbine means is positioned to receive water flowing past the stator means and operates the nozzle outer gear through a planetary gear and idler gear chain.

Water spray deflector means are also provided in association with the nozzle for breaking up the water spray from the nozzle to maintain and even precipitation over the pattern, the deflector means being responsive to the water pressure within the nozzle in order to produce a greater deflection of low pressure streams and a lesser deflection of high pressure streams.

It is believed that a better understanding of the present invention, as well as a recognition of additional objects and various advantages thereof will become apparent to those skilled in the art from a consideration of the following detailed description of a preferred exemplary embodiment thereof. Reference will be made to the appended sheets of drawings which will be first briefly described.

BRIEF DESCRIPTION OF THE DRAWING

FIG. 2 is a section view of the sprinkler of FIG. 1 taken therein along the plane II—II;

FIG. 3 is a horizontal section view of the sprinkler of FIG. 2 taken therein along the plane III—III;

FIG. 4 is a detailed section view of a portion of the sprinkler of FIG. 3 taken therein along the plane IV—IV and showing the manually operable means for advancing the annular pattern plate means in a detented position;

FIG. 5 is a view as in FIG. 4 showing the manually operable means in an undetented position during advancement of the annular pattern plate;

FIG. 6 is a horizontal section view of the manually operable means of FIG. 5 taken therein along the plane VI—VI;

FIG. 7 is a detailed section view of a portion of the sprinkler housing of FIG. 3 taken therein along the plane VII—VII;

FIG. 8 is a horizontal section view of the sprinkler of FIG. 2 taken therein along the plane VIII—VIII;

FIG. 9 is a detailed view of the exemplary stator means of the present invention shown during low water pressure conditions in the water passage in which the stator means is located;

FIG. 10 is a side view of the stator means of FIG. 9;

FIG. 11 is a view as in FIG. 9 showing the exemplary stator means in a position assumed under higher water pressure conditions;

DETAILED DESCRIPTION OF A PREFERRED EXEMPLARY EMBODIMENT

Figure 1:
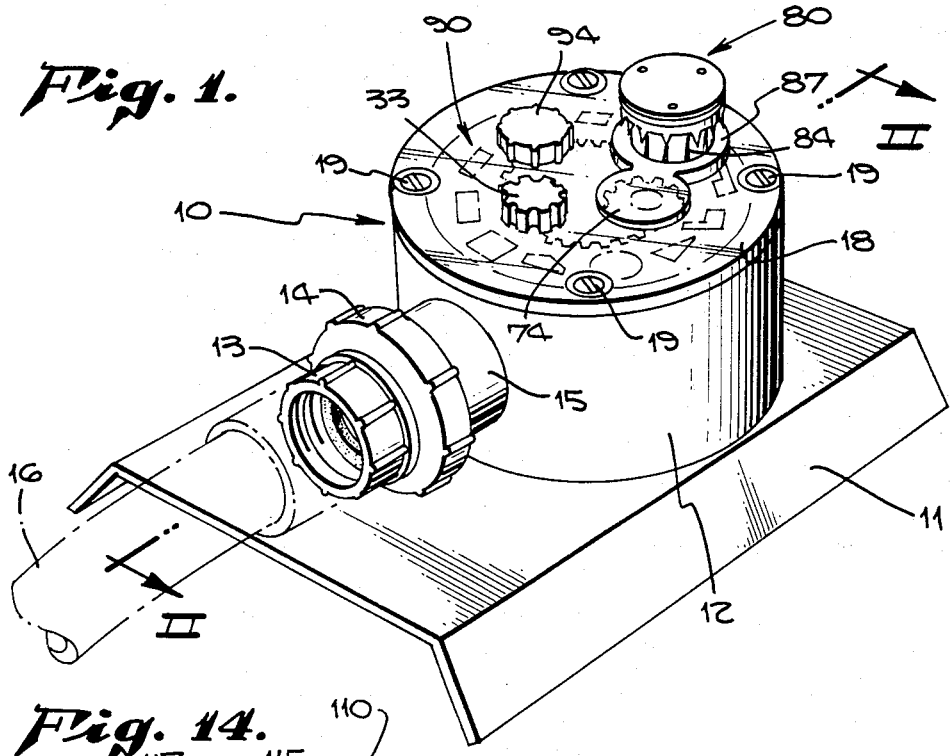
FIG. 1 is a top prespective view of a preferred exemplary embodiment of hose end pattern sprinkler in accordance with the present invention.

Referring initially to FIG. 1, an exemplary embodiment of hose end pattern sprinkler in accordance with the present invention, is indicated generally at 10 and includes a base 11 upon which sprinkler housing 12 is supported, there being a hose and coupling 13 secured by a mounting collar 14 turned onto a threaded end of cylindrical inlet 15 to facilitate the connection of a water conduit, such as a garden hose indicated at dotted line at 16. As seen in FIG. 2 a conventional filter screen cup 17 may be located in the inlet 15 with the housing 12 comprising a chambered, preferrably one piece injection molded plastic part having a housing cover 18 secured thereto by a appropriate fasteners such as screws 19.

As is contemplated within the present invention hose end pattern sprinkler, a pressure regulator means indicated generally at 20 in FIG. 2, is provided for regulating water pressure within housing 12 supplied by inlet 15. As best seen in FIG. 2, the exemplary pressure regulator is preferably provided in accordance with the construction and the mode of operation of the disclosure of my co-pending application for U.S. Letters Patent Ser. No. 236,010, filed Feb. 19, 1981 and entitled "Pressure Regulating Valve", now abandoned the disclosure of which is incorporated herein by this reference. As more fully described in said co-pending application Ser. No. 236,010, and as seen in FIG. 2, the exemplary pressure regulator means includes an inlet 21, an outlet 22 down stream of the inlet, a valve seat 23 disposed therebetween and a valve member 24 having an upstream surface 25 adapted to seat on valve seat 23 and a downstream surface 26 facing downstream pressure in the outlet 22. A piston 27 in connected by stem 28 to valve member 24 and is in fluid sealed relation by virtue of diaphram 29 with the surrounding cylinder 30 formed integrally of housing 12. A spring 31 engages piston 27 at one end and rests in a spring cup retainer 32 at it opposite end, the position of retainer 32 being adjustable by turning stem 33 via handle 34. A top cap 35 surrounds the retainer 32 and spring 31, closing the upper portions of housing portion 30 with a bottom cap 36 closing the lower portions of housing portion 30. A closing spring 37 is positioned between bottom cap 36 and the under surface 26 of valve member 24. As can be seen from the foregoing, and reference to application Ser. No. 236,010, the valve member 24 is preloaded toward a valve open position by spring 31, the bias of which can be adjusted by turning knob 34, and the inlet water pressures are balanced by being applied to both the upper surface 25 of valve member 24 and the under surface of piston 27. The valve member thus reacts solely to the downstream pressure in outlet 22, the valve member closing when downstream pressure exceeds the predetermined preload force being applied by the resultant of the spring forces of springs 31 and 37 on valve member 24. Such pressure regulated water flow from inlet 21 and valve port 38 then passes to the outlet 22 where it impinges upon the exemplary stator means which will now be explained.

Variable stator means, responsive to water flow pressures, are provided in the exemplary embodiment in order to shape the flow of water from the regulator means indicated generally at 20. In the exemplary embodiment, such variable stator means are indicted generally at 40 in FIGS. 2 and 8–11. As can be seen in FIGS. 2 and 8, a generally rectangular water passage 45 is provided by intergrally formed wall portions of housing 12 and which communicate with the outlet 22 of the exemplary pressure regulator means. As is particularly contemplated within the present invention, such stator means, in the present embodiment comprises a leaf spring 41 of curved configuration having a nozzle effecting notch 42 at one end thereof. As best seen in FIGS. 8 and 9, one end 43 of leaf spring 41 is bent to rest against an intergral portion of port 38 of the pressure regulator means with a barb 44 engaging wall portions of the regulator means housing 30 to mount the leaf spring base along one wall of rectangular cross-sectioned passage 45. A central portion of the leaf spring is bent in curved configuration to place the opposite or free end 46 in abutting engagement with an opposite wall **45*b* of passage 45. The aperture there through provided by notch 42 produces a nozzle like effect shaping a stream of water flowing passed the stator toward the exemplary turbine means discussed hereinafter, and as seen in FIG. 9 during low water pressures. When water pressures in passage 45 exceed a predeterminable amount, the leaf spring 41 will bend away from wall 45*b*, as seen in FIG. 11 allowing a wider stream to flow thereby toward the exemplary turbine means. The leaf spring stator thus provided operates to produce a variable width stream of water directed toward the turbine means as the water pressures vary in passage 45 in response to manual operation of the exemplary pressure regulator means indicated generally at 20**.

Figure 12:
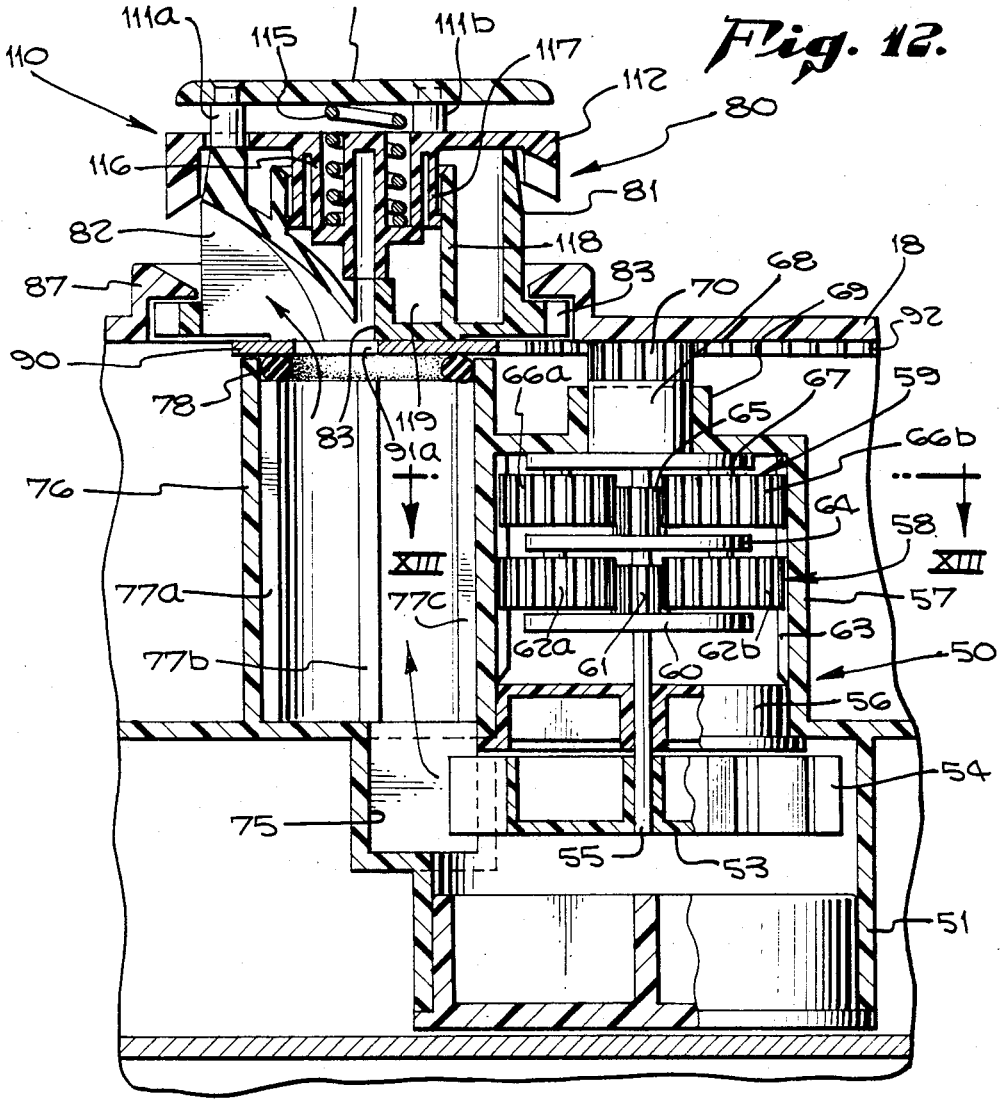
FIG. 12 is a section view through the sprinkler of FIG. 3 taken therein along the plane XII—XII.

Water turbine means are generally indicated at 50, as best seen in FIGS. 2, 8 and 12 which may be made in accordance with the disclosure of my prior U.S. Pat. No. 3,854,664, the disclosure of which is incorporated herein by this reference. A turbine housing 51 is formed integrally of housing 12 with an inlet 52 opening the turbine housing to water passage 45. An impellor wheel 53 having vanes 54 is mounted by shaft 55 which passes through a lower cap 56 of gear housing 57, formed integrally of housing 12, in which a planetary gear drive transmission is provided. As can be seen in FIGS. 2 and 8, water flow passing the exemplary leaf spring stator means indicated generally at 40 is directed against the vanes 54 of the water turbine means to rotate shaft 55 in response to water flow thereby.

Figure 13:
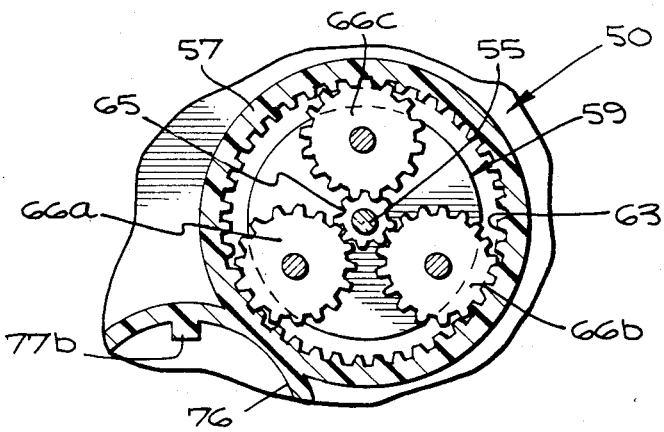
FIG. 13 is a detailed horizontal section view of the planetary gear drive of the exemplary water turbine means of FIG. 12 taken therein along the plane of XIII—XIII.

As best seen in FIG 12, the exemplary planetary gear drive includes a plurality of gear sets, two exemplary sets being indicated generally at 58 and 59, respectively. The gear drive includes the provision of a support plate 60 secured to shaft 55 and mounting drive gear 61. A set of three planetary gears, as gears 62*a* and 62*b*, are rotatably suspended in engagement with stationary internal gear 63 from support disk 64 which in turn mounts a drive gear 65. A second set of three planetary gears, as best seen in FIGS. 12 and 13, and including gears 66*a*, 66*b* and 66*c*, are rotatably mounted from a support plate 67 which in turn mounts stub shaft 68 passing through gear housing collar 69 where transmission output gear 70 is provided. While two planetary gear sets are illustrated, it should be understood that more or less such sets can be employed in the planetary gear drive for operating the transmission output gear 70 from the water drive input of impeller wheel 33.

The output of transmission gear 70 is employed in the exemplary embodiment for operating the exemplary embodiment of sprinkler nozzle, indicated generally at 80, as will be hereinafter explained. An idler gear 71, as seen in FIGS. 2 and 3, is provided to transmit the output of gear 70 to the nozzle means with the idler gear being mounted by its shaft 72 in support 73 formed intregrally of housing 12. A housing cap 74 is illustrated over the idler gear, although if the cover 18 is provided of sufficient thickness the idler gear 71 may merely reside within a recess formed in the cover. However, it is desirable to have the idler gear 71 of double vertical height in order that a lower portion thereof may mesh with gear 70 of the transmission means with an upper portion thereof meshing with an outer gear 83 formed on nozzle head 81 as seen in FIG. 2. Water flow also occurs from the exemplary turbine means to the exemplary nozzle means via the turbine housing outlet 75, as seen in FIG. 12, with the water path then going through the riser 76 formed intregrally with housing 12, straightening ribs provided in the riser, such as ribs 77*a*, 77*b* and 77*c* causing the swirling water stream to straighten as it approaches the exemplary nozzle means. An O-ring seal 78 is provided at the top of the riser 76 where it underlies the annular pattern plate described hereinafter.

Figure 14:
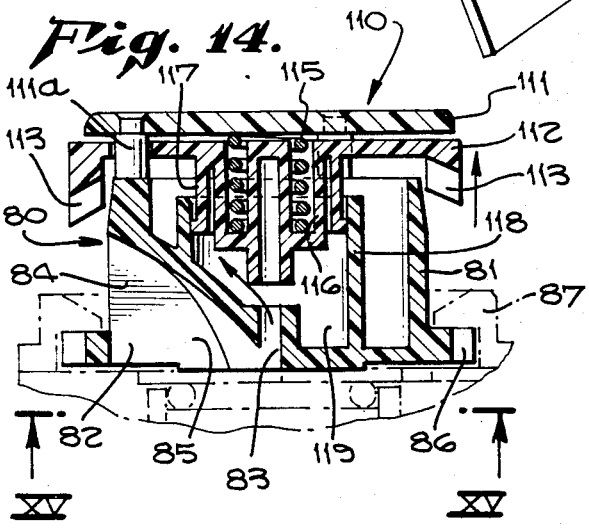
FIG. 14 is detailed section view of the nozzle means of FIG. 12 showing the associated exemplary embodiment in deflector means raised to a minimum deflection position in response to water pressure within the nozzle means in accordance with the present invention.
Figure 15:
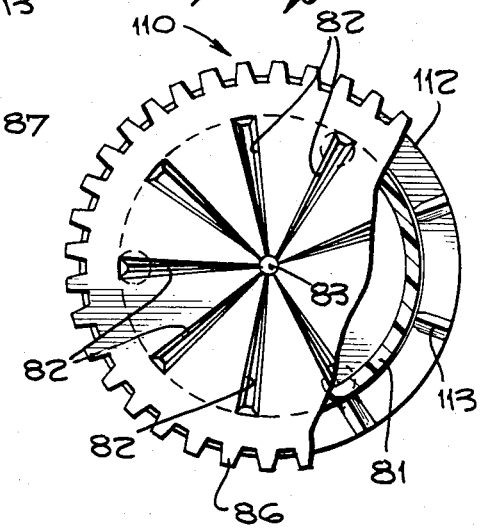
FIG. 15 is a bottom view, partially in section, of the exemplary nozzle means of FIG. 14 taken therein in along the plane XV—XV.

Sprinkler nozzle means are provided in the exemplary embodiment which nozzle may be made in accordance with the disclosure of my co-pending application for U.S. Letters Patent Ser. No. 241,625 filed Mar. 9, 1981 and entitled "Pattern Sprinkler Head", now abandoned, but refiled as a continuation application on Feb. 23, 1983, as U.S. Ser. No. 469,027 now U.S. Pat. No. 4,471,908; the disclosure of which is incorporate herein by this reference. In the exemplary embodiment, such nozzle means, indicated generally at 80, include a cylindrical body 81 having a plurality of triangular shaped bottom inlets 82 with apexes thereof, as sen in FIG. 15, extending to and merging into a central bore 83. Each inlet extends in arcuate fashion vertically upwardly to a side outlet 84 of upstanding triangular configuration. The nozzle water passage, as 85 in FIG. 14, is formed as a projection of such triangular configurations moving in arcuate fashion from the inlets 82 to the outlet 84. Importantly, the individual triangular inlets 82 have their radially inward extent merging into a center line of the nozzle such that central portions of the nozzle underside function as nozzle inlets in association with pattern orifices centered thereunder as discussed hereinafter. The utilization of central portions of the cylindrical nozzle body as water inlets is accomplished by having a peripheral drive in the form of outer gear 86, as opposed to having a central shaft drive as prior art nozzle constructions.

The nozzle means, indicated generally at 80, is rotated through the engagement of its outer gear 86 with the upper hlf of idler gear 71 as seen in FIG. 2. As seen in FIGS. 1 and 14, a housing 87 may be provided in cover 18 to receive the gear 86 with such housing 87 opening to housing 74 so that the respective gears 86 and 71 contained therein are in meshing relationship. Alternatively, both housing 87 and 74 can be formed as recesses in as sufficiently thick top plate 18.

Annular pattern plate means, as particularly contemplated within the present invention, are provided to selectively determine the spray pattern of water emitted from the nozzle means indicated generally at 80. In the exemplary embodiment, an annular pattern plate 90 of ring configuration is provided directly below the top cover 18 and the exemplary nozzle means indicated generally at 80, as best seen in FIGS. 2 and 12. The ring like pattern plate 90 is preferably provided with a plurality of pattern orifices 91 in a single file sequential annular array around the plate with a variety of configurations such as the exemplary L-shaped orifices 91*a*, left hand flag configuration orifice 91*b*, right hand flag configuration orifice 91*c*, triangular configuration orifice 91*d*, circular configuration orifice 91*e*, sculptured rectangular configuration orifice 91*f*, square configuration orifice 91*g*, and varying width rectangular configuration orifices 91*h* through 91*l*. An internal gear 92 is formed on an inner periphery of plate 90 and in engaged by drive pinion gear 93 as seen in FIG. 3.

Referring now to FIG. 4, it can be seen that the drive pinion is manually operable by handle 94 which is associated with a detent means for facilitating alignment of individual orifices 91 beneath the nozzle body 81 as seen in FIG. 12. The exemplary detent means are indicated generally at 95, in FIG. 4, and include the provision of a detent plate 96 having a detent or ridge 97*a* and 97*b* extending on opposite sides of a center post 98 extending between plate 96 and handle 94. A recess or groove 99, as seen in FIG. 5, is provided on the under surface of a housing portion 18*a* which may be formed integrally of housing cover 18 in the form of a boss as illustrated or as a recess in a thicker cover. Each of the orifices are spaced around the annular ring plate 90 in relation to the location of internal gear teeth 92 in such a manner that an engagement of detent ridges 97*a* and 97*b* in groove 99 under the urging of spring 100 will align a selected one of the orifices 91 to the center line of the cylindrical nozzle body 81, as orifice 91*a* is aligned to a center line of the nozzle body 81 in FIGS. 3 and 12. As further seen in FIG. 4, spring 100 is supported by a spring retaining upper post 101, retaining washer 103 and lower support post 102 in operative relation beneath the pinion gear 93. Plate 96, post 98 and handle 94 subassembly which move together from the detented position of FIG. 4 to the undetented position of FIG. 5 by manual manipulation of handle 84 externally of housing 12. Plate 90 may be mounted in its cooperation relation thereto by the provision of four support posts 12*a*, 12*b*, 12*c*, 12*d* as seen in FIG. 3 with outer marginal areas of plate 90 engaging on arcuate ledges, as ledge 104 on post 12*a* in FIG. 7.

Figure 16:
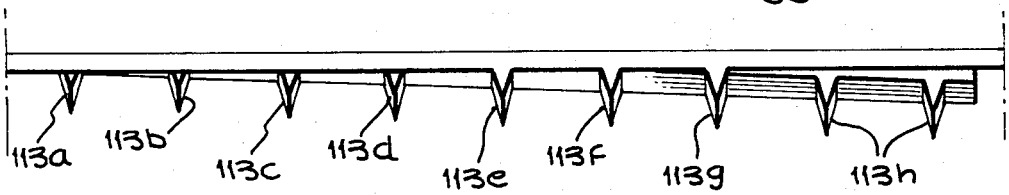
FIG. 16 is a projection of the circumference of the exemplary deflector means showing the sequence of increasing length deflector vanes about the deflector means periphery.

Stream deflector means are provided in accordance with the present invention for breaking up the water spray streams emitted by the exemplary nozzle in a manner responsive to the water pressure within the nozzle as is particularly contemplated within the present invention. In the exemplary embodiment, the exemplary stream deflector is indicated generally at 110 in FIGS. 2, 12 and 14. As a part thereof, a stationary top cap 111 is secured by three posts 111*a*, 111*b*, and 111*c* to the nozzle body 81 in vertically spaced above relation as best seen in FIGS. 12 and 14. A deflector wheel 112 having a plurality of depending deflector vanes 113*a* through 113*h* of progressively greater length, as seen in FIG. 16 is mounted between the nozzle body 81 and cap 111 with the three posts 111*a*–111*c* passing through somewhat larger ports 114 such that wheel 112 is free to ride up and down relative nozzle body 81 in the space between body 81 and cap 111. Means are provided to normally bias the deflector wheel 112 down toward the nozzle cylindrical body toward a maximum deflection position as seen in FIG. 12, and includes in the exemplary embodiment, a coil spring 115 located beneath cap 111 and residing in a spring retaining cup 116 formed integrally of deflector wheel 112. A resilient walled piston member 117 is formed about cup 16, as seen in FIG. 12, integrally of wheel 112 to ride with its bottom end outwardly projecting ring in fluid tight engagement against the inside surface of cylinder 118 formed integrally of nozzle body 181. Cylinder 118 provides a water pressure chamber 119 which receives water under pressure from below the nozzle means via nozzle center port 83. Therefore, while spring 115 normally biases the deflector wheel 112 downwardly toward a maximum deflection position of FIG. 12, the build up of water pressures within risers 76, as seen in FIG. 12, passing upwardly through the nozzle body 81 will also pass through nozzle body center port 83 into chamber 119 to exert a force across the piston provided by piston member 117 to force the deflector wheel upwardly toward a minimum deflecting position as seen in FIG. 14 where it abuts beneath cap 111. The position of deflector wheel 112, and thus its extent of nozzle spray deflection varies in direct response to an increase of decrease in water pressures within the nozzle in accordance with a part of the present invention.

Having thus described a preferred exemplary embodiment of hose end pattern sprinkler together with its exemplary pressure regulator means, variable stator means, water turbine means, annular pattern plate means, manual means for adjusting the same and stream deflector means it should be understood by those skilled in the art that various modifications, adaptations and alterations thereof may be made within the scope and spirit of the present invention which is defined by the following claims.

I claim:

1. A pattern sprinkler having a housing, a water inlet to said housing, nozzle means for spraying water from said housing and a water passage within said housing communicating between said inlet and said nozzle means, said sprinkler further comprising:

an annular pattern plate means having a plurality of different configured spray pattern orifices provided threin in a circular array;

means for mounting said annular pattern plate means in the path of water flow through said water passage between said inlet and said nozzle means to control the pattern of water spray from said nozzle means in response to the particular spray pattern orifice positioned in the path of said water flow; and water spray deflector means associated with said nozzle means for breaking up the nozzle water sprays emitted by said nozzle means, said deflector means including a plurality of deflection vanes biased toward a maximum spray deflecting position and water pressure operated means for urging said deflector vanes toward a minimum deflecting position in response to water pressure within said nozzle means.

2. A pattern sprinkler having a housing, a water inlet to said housing, nozzle means for spraying water from said housing and a water passage within said housing communicating between said inlet and said nozzle means, said sprinkler further comprising:

an annular pattern plate means having a plurality of different configured spray pattern orifices provided therein in a circular array;

means for mounting said annular pattern plate means in the path of water flow through said water passage between said inlet and said nozzle means to control the pattern of water spray from said nozzle means in response to the particular spray pattern orifice positioned in the path of said water flow;

pressure regulator means in said housing connected to said inlet and having a water pressure outlet for regulating the pressure of water flowing from said inlet through said water pressure outlet, said pressure regulator means including an externally manually adjustable means for varying the pressure setting of said regulator means; and a leaf spring having one end secured adjacent one side of the water pressure outlet from said regulator means, a curved body portion extending across said water passage with an opposite spring end engaging against an opposite side of said passage during low water pressures in said passage and a nozzle effecting notch in said free end of said leaf spring whereby water flow in said water passage at lower pressures go through said notch with water flow of higher pressures bending said leaf spring to allow water flow to pass between said opposite spring end and the adjacent water passage wall in addition to through said notch.

3. The pattern sprinkler of claim 2 further comprising:

water turbine means including an impellor wheel with turbine vanes positioned in the path of water flow past said leaf spring; and rotatable nozzle means driven by said water turbine means and in fluid communication with said water flow for spraying water outwardly about said sprinkler housing.

4. The pattern sprinkler of claim 3 wherein said water turbine means impeller wheel turbine vanes are positioned in the path of water flow through said notch.

5. A pattern sprinkler having a housing, a water inlet to said housing, nozzle means for spraying water from said housing and a water passage within said housing communicating between said inlet and said nozzle means, said sprinkler further comprising:

an annular pattern plate means having a plurality of different configured spray pattern orifices provided therein in a circular array;

means for mounting said annular pattern plate means between said inlet and said nozzle means to control the pattern of water spray from said nozzle means in response to the particular spray pattern orifice positioned in the path of said water flow;

water turbine means positioned in the path of said water flow in said water passage; and wherein said nozzle means further comprises:

(i) a cylindrical body having a plurality of triangularly shaped bottom water inlets with apexes thereof extending to the body bottom center, vertical side nozzle outlets of upright triangular configuration and arcuate flow paths between each of said inlets and outlets, respectively, whereby a plurality of nozzle outlets are provided through said nozzle means with the nozzle inlets active area extending on the bottom thereof to the center of the body; and (ii) an external gear provided about said cylindrical body for rotating the same off of the drive of said water turbine means.

6. A pattern sprinkler having a housing, a water inlet to said housing, nozzle means for spraying water from said housing and a water passage within said housing communicating between said inlet and said nozzle means, said sprinkler further comprising:

an annular pattern plate means having a plurality of different configured spray pattern orifices provided therein in a circular array, wherein said annular pattern plate means includes:

(i) a flat annular plate of ring configuration having said pattern orifices spaced in a single file array about said ring; and (ii) an internal gear provided on an inner surface of said ring;

means for mounting said annular pattern plate means in the path of water flow through said water passage between said inlet and said nozzle means to control the pattern of water spray from said nozzle means in response to the particular spray pattern orifice positioned in the path of said water flow;

manually operated drive gear means for rotating said ring through engagement with said internal gear to rotate said ring to place said pattern orifices individually and sequentially into alignment beneath said nozzle means; and detent means for locating said pattern plate in selected positions of rotation to facilitate alignment of each pattern orifice to said nozzle means.

7. In a sprinkler having a water inlet, a water dispensing nozzle and a water flow passage communicating between said inlet and nozzle, the improvement comprising the provision of:

a leaf spring for shaping water flow through said passage into a variable width stream in response to the water pressure of water flowing through said passage, said leaf spring having one end secured adjacent one side of said water passage, a curved body portion extending across said water passage with an opposite spring end engaging against an opposite side of said passage during low water pressures in said passage and a nozzle effecting notch in said free end of said leaf spring whereby water flows in said water passage at lower pressures go through through said notch with water flows of higher pressures bending said leaf spring to allow water flow to pass between said opposite spring end and the adjacent water passage wall in addition to through said notch.

8. The improvement in sprinkler of claim 7 including the additional provision of:

pressure regulator means connected into said passage between said inlet and said stator means for regulating the pressure of water flowing to said leaf spring, said pressure regulator means including a valve closing member operatively balanced against inlet pressures to move between valve open and valve close positions solely in response to changes in water pressure in said passage between said regulator means and said stator means.

9. In a sprinkler having a water inlet, a water spraying nozzle and a water flow passage communicating between said inlet and nozzle, the improvement wherein said nozzle comprises:

a cylindrical body having a plurality of triangularly shaped bottom water inlets with apexes thereof extending to a center of the body bottom, vertical side nozzle outlets of upright triangular configuration and arcuate flow paths between each of said inlets and outlets, respectively, whereby a plurality of nozzle outlets are provided through said nozzle with the nozzle inlets active areas extending on the bottom thereof to the center of the body.

10. The impovement in sprinkler of claim 9 wherein said nozzle further comprises:

an external gear provided about said cylindrical body for rotating the same off of a drive means.

11. In a sprinkler having a water inlet, a water spray nozzle means and a water flow passage communicating between said inlet and said nozzle means, the improvement comprising the provision of:

water spray deflector means associated with said nozzle means for breaking up the nozzle water sprays emitted by said nozzle means, said deflector means including a plurality of deflection vanes biased toward a maximum spray deflecting position and water pressure operated means for urging said deflector vanes toward a minimum deflecting position in response to water pressure within said nozzle means.

12. The improvement in sprinkler of claim 11 wherein:

a cap is fixedly mounted to said nozzle in vertically spaced relation with said spray deflector means including a deflection vane mounting wheel positioned between said cap and nozzle; and spring means are positioned between said cap and deflection wheel for biasing the later downwardly toward said nozzle.

13. The improvement in sprinkler of claim 12 wherein:

said nozzle is provided with a center bore opening to water pressure of water entering the nozzle and an inner pressure chamber forming cylinder communicating with said bore; and said deflection means includes a piston portion located in said cylinder and connected to said deflection vane mounting wheel whereby water pressure in said chamber biases said wheel upwardly against the downward bias of said spring means.

14. The improvement in sprinkler of claim 13 wherein said piston portion of said deflection means includes a resilient depending skirt formed integrally of said vane mounting wheel and said skirt has an intregral bottom end outwardly projecting ring engaging inner sides of said cylinder in fluid tight relation.

15. The improvement in sprinkler of claim 11 wherein said plurality of deflection vanes are provided in a series of progressively longer length vanes extending from a first vane at a given reference point around a closed circular path to a last vane portioned adjacent said first vane.

16. A hose end pattern sprinkler having a sprinkler housing supported on a base with a hose end coupling for supplying water through an inlet into the housing and comprising:

pressure regulator means in said housing connected to said inlet and having a water passage outlet for regulating the pressure of water flowing from said inlet through said water passage outlet, said pressure regulator means including an externally manually adjustable means for varying the pressure setting of said regulator means;

means in said water passage outlet for variably restricting water flow thereby;

water turbine means including an impellor wheel with turbine vanes positioned in the path of water flow past said restricting means;

rotatable nozzle means driven by said water turbine means and in fluid communication with said water flow for spraying water outwardly about said sprinkler housing;

annular pattern plate means having a plurality of differently configured spray pattern orifices spaced in an a circular array thereabout;

means for movably mounting said pattern plate means beneath said nozzle means in the path of said water flow for controlling the pattern of water spray from said nozzle means;

manual means operable externally of said housing for moving said annular pattern plate means to sequentially place selected ones of said pattern orifices in alignment with said nozzle means, and water spray deflector means associated with said nozzle means for breaking up the nozzle water sprays emitted by said nozzle means, said deflector means including a plurality of deflection vanes biased toward a maximum spray deflecting position and water pressure operated means for urging said deflector vanes toward a minimum deflecting position in response to water pressure within said nozzle means.

17. The hose end pattern sprinkler of claim 16 wherein said pressure regulator means includes a valve closing member operatively balanced against inlet water pressure so as to move between valve opened and valve closed positions solely in response to the water passage outlet pressure.

18. The hose end pattern sprinkler of claim 16 wherein said variable stator means comprises:

a leaf spring having one end secured adjacent one side of the water passage outlet from said regulator means, a curved body portion extending across said water passage with an opposite spring end engaging against an opposite side of said passage during low water pressures in said passage and a nozzle effecting notch in said free end of said leaf spring whereby water flows in said water passage at lower pressures go through said notch with water flows of higher pressures bending said leaf spring to allow water flow to pass between said opposite spring end and the adjacent water passage wall in addition to through said notch.

19. The hose end pattern sprinkler of claim 18 wherein said water turbine means impeller wheel turbine vanes are positioned in the path of water flow through said notch.

20. The hose end pattern sprinkler of claim 16 wherein said nozzle means comprises a cylindrical body having a plurality of triangularly shaped bottom water inlets with apexes thereof extending to the bottom center, vertical said nozzle outlets of upright triangular configuration and arcuate flow paths between each of said inlets and outlets, respectively, whereby a plurality of nozzle outlets are provided through said nozzle means with the nozzle inlets active area extending on the bottom thereof to the center of the body.

21. The hose end pattern sprinkler of claim 20 wherein said nozzle means further comprises:

an external gear provided about said cylindrical body for rotating the same off of the drive of said water turbine means.

22. The hose end pattern sprinkler of claim 16 wherein said annular pattern plate means comprises:

a flat annular plate of ring configuration having said pattern orifices spaced in single file array about said ring, an internal gear provided on an inner surface of said ring and drive gear means associated with said manual means for driving said ring through engagement with said internal gear to rotate said ring to place said pattern orifices individually and sequentially into alignment beneath said nozzle means.

23. The hose end pattern sprinkler of claim 16 wherein said manual means further includes detent means for locating said pattern plate means in selected positions of rotation to facilitate alignment of each pattern orifice to said nozzle means.

24. The hose end pattern sprinkler of claim 20 wherein said annular pattern plate means is so provided to place said spray pattern orifices centered below and aligned to a vertical center line of said nozzle means cylindrical body.

* * * * *